United States Patent [19]

Mantell

[11] Patent Number: 4,580,732

[45] Date of Patent: Apr. 8, 1986

[54] FILTER CAKE PROCESSING METHOD AND MECHANISM

[76] Inventor: Myron E. Mantell, 4 Rudden La., Morris Plains, N.J. 07950

[21] Appl. No.: 619,686

[22] Filed: Jun. 13, 1984

Related U.S. Application Data

[63] Continuation of Ser. No. 354,833, Mar. 4, 1982, abandoned.

[51] Int. Cl.[4] ..... B02C 1/00

[52] U.S. Cl. ..... 241/30; 241/94; 241/262; 241/283; 241/DIG. 30

[58] Field of Search ..... 241/84.3, 87, 88.4, 241/94, 30, 262, 266, 283, 273.2, 296, DIG. 30, 238

[56] References Cited

U.S. PATENT DOCUMENTS

| | | | |
|---|---|---|---|
| 656,297 | 8/1900 | Morris | 241/94 |
| 2,854,932 | 10/1958 | Rochowiak et al. | 241/238 X |
| 4,013,232 | 3/1977 | Broughton | 241/3 |

*Primary Examiner*—Mark Rosenbaum
*Attorney, Agent, or Firm*—Sheldon H. Parker

[57] ABSTRACT

The invention relates to a shredding apparatus for use in shredding a material mass into a plurality of discrete particles. The principal components includes a shredding screen and wiper blades. The wiper blade include a semi-rigid blade having its lower end in firm contact with said shredding screen. Reciprocating means is fixed to the shredding screen means to provide reciprocating motion of the shredding screen relative to said wiper blade. The reciprocating means produces a length of travel of said shredding screen at least equal to the space between an adjacent pair of wiper blades. Each of said wiper blades are parallel to each other and to a first set of spaced parallel bars. A second set of spaced parallel bars are substantially perpendicular to the first set of spaced parallel bars thereby forming a plurality of openings having a predetermined cross-sectional area substantially equal to the required cross-sectional area of said discrete particles. During each pass of the reciprocating motion the lower edge of each wiper blade repeatedly slides along the top of a bar of said first set of spaced parallel bars, snaps downward towards the second set of spaced parallel bars.

7 Claims, 7 Drawing Figures

FILTER CAKE PROCESSING METHOD AND MECHANISM

This application is a continuation of application Ser. No. 354,833, filed Mar. 4, 1982, now abandoned.

TECHNICAL FIELD

This invention relates to a method and mechanism for shredding a filter cake which has a pasty consistency, and transporting shredded filter cake particles to a drier mechanism.

BACKGROUND ART

The prior art systems used for transfering a filter cake from a filter press to a dryer typically involved shoveling of the filter cake mass onto pan and drying the mass. In the case of a great number of materials, the shoveling operation can easily be an all day project because the filter cake mass has a pasty or peanut butter like consistency. The filter cake tends to stick to the shovel, making the operation extremely inefficient. The drying operation must be continued until the filter cake is totally dry and could require a full week in the dryer because of the difficulty of drying the center of the mass of the filter cake. The drying time is directly related to the amount of exposed surface area, and therefore great efforts have been made to convert the filter cake mass into relatively small particles. Among the systems employed for converting the filter cake mass into particles is a mechanism which required a large, expensive, high energy consuming hydraulic ram. Attempts to use a blender type of mechanism have proven to be unsuccessful because the wiper blades of the blender tend to work the filter cake mass for an extended period and produce a liquified product. The pasty consistency of the filter cake has proven to render the granulating or pulverizing of the filter cake extremely difficult.

SUMMARY OF THE INVENTION

It has now been found that the problems encountered with the prior art systems can be overcome through the use of a wiper blade in combination with a shredding screen. In accordance with the present invention, a wiper blade of a resilient though stiff material is drawn across a shredding screen which is formed of a first set of spaced parallel bars and a second set of parallel spaced bars. The second set of spaced parallel bars are at a right angle to the first set of spaced parallel bars. The wiper blade is a semi-rigid member formed of a material such as a hard urethane or rubber. The lower end of the wiper blade is positioned for firm contact with the spaced parallel bars of the shredding screen. The upper section of the wiper blade is supported for limited oscillatory movement in order to act on the filter cake during the shredding operation. The process involves dumping the filter cake into a hopper which sits over the shredding screen. The shredding screen is moved relative to the wiper blade thereby forcing the filter cake mass through the shredding screen as descrete particles. The descrete particles can be collected in a pan and conveyed to a dryer.

The system of the instant invention provides among its advantages, the rapid production of descrete particles with a relatively low energy requirement for the particle forming operation and the increase in speed of the drying operation with a concomittent decrease in the energy requirement of the drying operation.

BRIEF DESCRIPTION OF THE DRAWINGS

The objects and advantages of the invention will become more apparent and more readily understood when the following detailed description of the invention is read in conjunction with the drawings wherein.

MODE OR MODES FOR CARRYING OUT THE INVENTION INCLUDING THE BEST MODE

The device of the present invention is a filter cake shredder for dryer pan loading or loading in drums for bulk sale. The filter cake shredder and pan loader assembly 100 employs a live bottom and can be positioned directly under the filter or can receive filter cake from filter cake pans or other containers.

Figure 1:
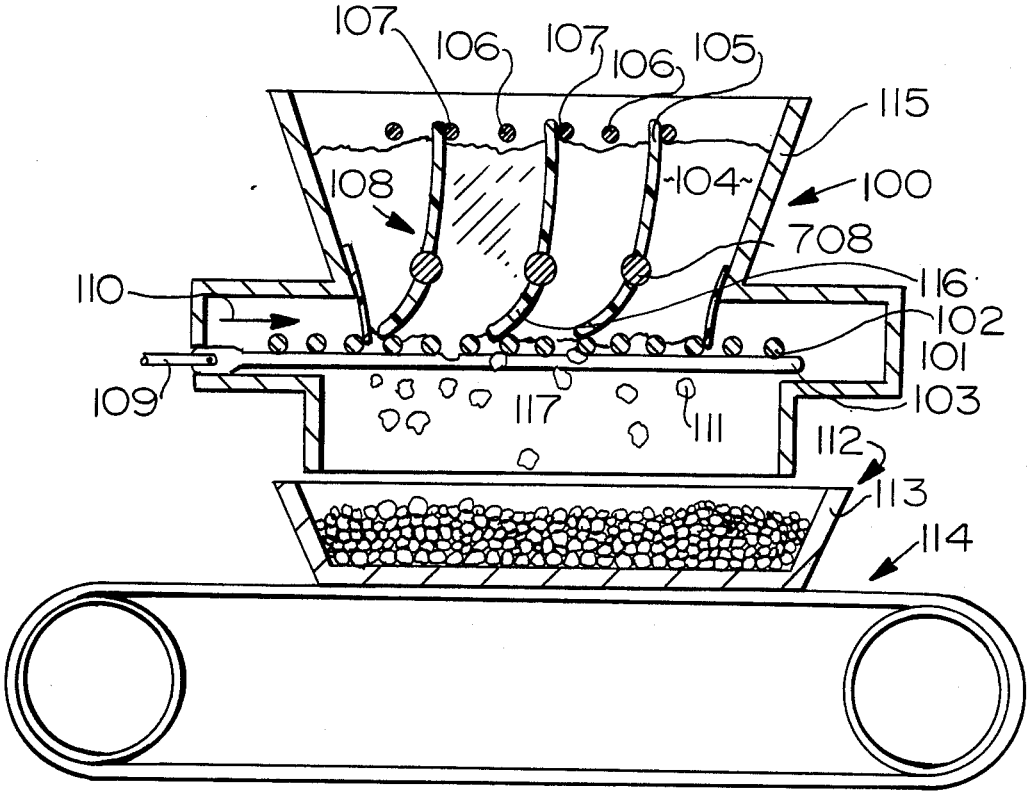
FIG. 1 is a schematic cross-sectional side view of a shredding and collecting assembly of the instant invention.

As shown in FIG. 1, a filter cake shredder and pan loader assembly 100 is provided for receiving filter cake from a filter (not shown). The filter can be a pressure filter such as a plate and frame press, a vacuum, centrifugal or gravity filter. The type of filtration employed and the material of the filter cake are not narrowly critical with respect to the present invention.

However, the apparatus and methods of the invention have particular utility in connection with filter cakes which are of a pasty or dough-like consistency and which can be as thick and viscous as peanut butter, or can have a consistency characteristic of putty or clay. The material which is being processed can be any wet product such as a pigment, food stuff such as beet-sugar, paper pulp or other product of the filter. These types of filter cakes are particularly difficult to handle because of their tendency to stick to processing tools such as shovels, thereby rendering the transferring of the material quite difficult. Moreover, it is extremely difficult to force the material through extrusion orifices and ram devices employed for this type of operation are high in cost and power comsumption. During drying operations, the exposed surfaces lose water quite rapidly, but the interior regions are slow to dry. Since the drying operation must continue until the entire mass is completely dry, drying of a pasty filter cake can require a full week. Similarly, the transferring of the material from the filter to the dryer can be a full day project. By way of contrast, the instant system can reduce the transferring operation to a continuous operation or at least an extremely fast process.

The filter cake 104 is dumped into the filter cake shredder and pan loader assembly 100 from a filter cake box or can be received directly from a filter located directly above the filter cake shredder and pan loader assembly 100. The filter cake shredder and pan loader assembly 100 is fitted with a live bottom mechanism or shuttle bar assembly indicated generally as 101. The shuttle bar assembly 101 includes shredder bars 102 and complementary cutter bars 103 which are moved in the direction of arrow 110. The shuttle bar assembly 101 is connected to a reciprocating drive mechanism, not shown, by means of the shuttle drive means 109. The filter cake 104 is forced through the space between the crossed bars 102 and 103, by the weight of the material, and most significantly by the relative movement between the shuttle bar assembly 101, the walls of the hopper 115 and the wiper blade assembly 108 with a shearing effect. The most significant and critical driving force is achieved by means of the interaction between the wiper blade lower end and the shredder bar 102. The filter cake 104 is prevented from accumulating or hanging up by virtue of the reciprocating motion of the wiper blade upper end 105. This motion is limited by wiper blade stop 106 and wiper blade stop 107. Since the wiper blade assembly 108 rotates or oscillates about the wiper blade rotational carrier bar 708, the limiting of motion of the upper end also confines the degree of movement of wiper blade lower end. The wiper blade assembly 108 is formed of a material which has a spring steel-like quality. A urethane polymer having a Durometer hardness of at least 90 (A scale) has been found to provide the combination of durability, corrosion resistance and resiliency.

The interaction between the wiper blade lower end and the filter cake 104 to form shredded particles 111 and fill pan 113 is explained in greater detail hereinafter, in association with FIGS. 2, 3, 4 and 5. The filter cake 104 passes through the shuttle bar assembly 101, as indicated by reference numeral 117 to form individual particles 111 of a predetermined size, dependent upon the size of the opening between the crossed bars of the shredder assembly 101, as well as the position of the wiper blade assembly 108 relative to the shuttle bar assembly 101, the speed of shuttle bar assembly 101 and the properties of filter cake 104. The collection of shredded particles 112 in the pan 113 can be transported by means of conveyor mechanism 114 to the desired destination. In certain circumstances the collection of shredded particles 112 is collected in drums for shipping, or for many applications is transported directly to a dryer.

Figure 2:
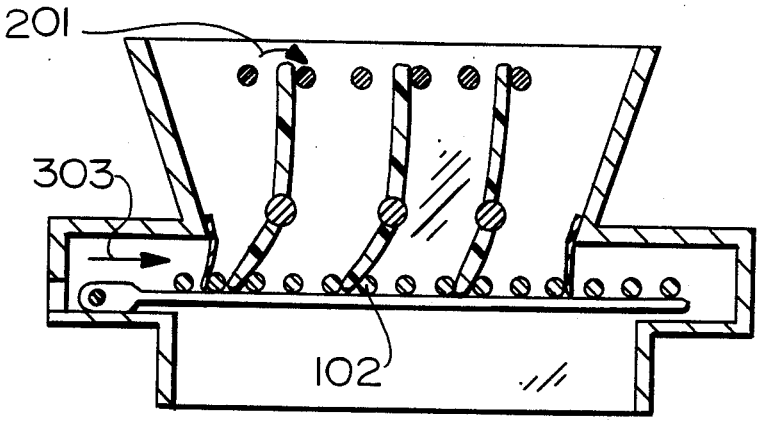
FIG. 2 is a side view of a shredder assembly showing the shredding screen in a first position relative to the wiper blade.
Figure 3:
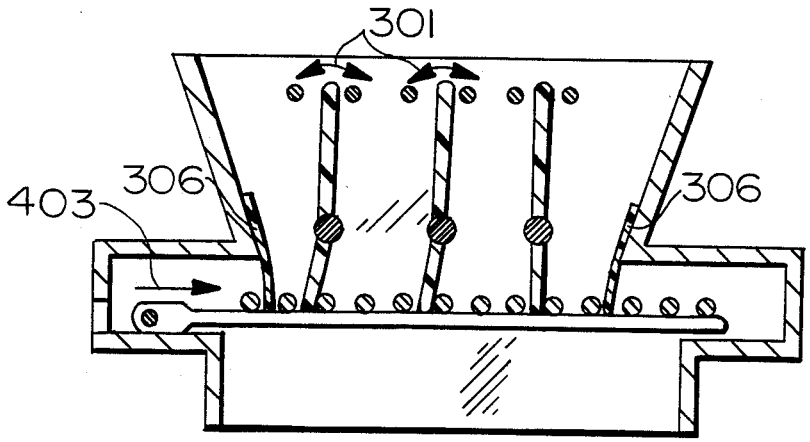
FIG. 3 is a side view of a shredder assembly showing the shredding screen in a second position relative to the wiper blade.
Figure 4:
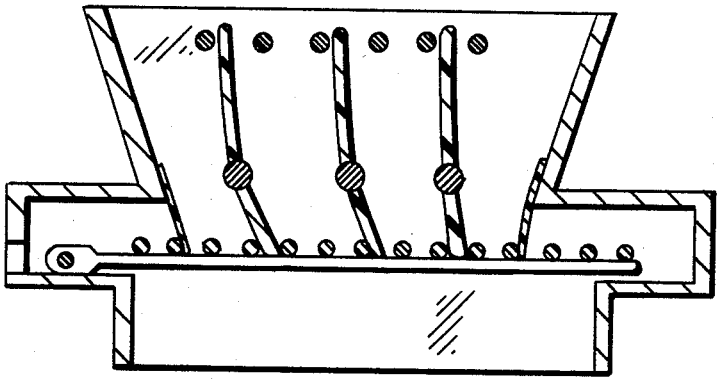
FIG. 4 is a side view of a shredder assembly showing the shredding screen in a third position relative to the wiper blade.
Figure 5:
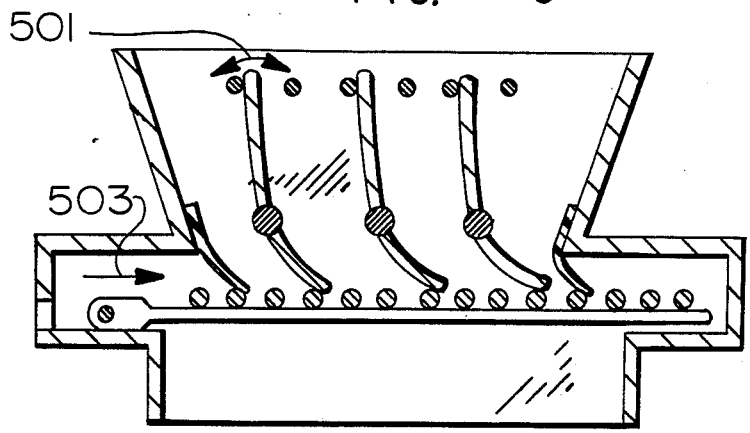
FIG. 5 is a side view of a shredder assembly showing the shredding screen in a fourth position relative to the wiper blade.
Figure 7:
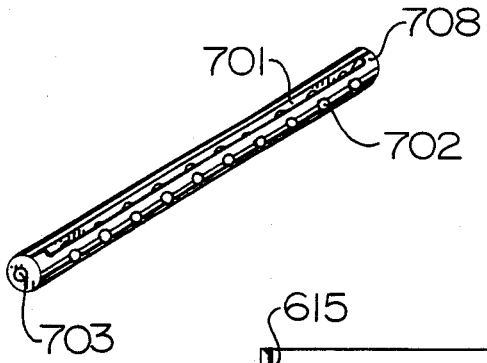
FIG. 7 is a perspective view of a wiper blade rotational carrier bar.

The shuttle bar assembly 101 is referred to as a live bottom because it moves relative to the housing. The wiper blade assembly 108 is not indepenently powered, but rather moves in response to movement of shuttle bar assembly 101. The wiper blade assembly 108 oscillates about the fulcrum point provided by wiper blade rotational carrier bar 708. The wiper blade lower end rides up and over the shredder bar 102 as shown in FIG. 2. The wiper blade resiliency can best be compared to spring steel. The wiper blade lower end 116 deforms initially, due to the force exerted on the wiper blade 108 by virtue of the blade being compressed between the wiper blade rotational carrier bar 708 and the shredder bar 102 or complemtary cutter bars 103. The lower end 116 of the plastic spring like wiper blade, as shown in FIG. 3, rides on the complementary cutter bar 103 as it moves between adjacent bars 102, unless the bottom of the wiper blade is notched so as to permit the wiper blade to extend below the lower bar.

The trailing end 130 of the wiper blade 108 can be notched so as to permit the wiper blade trailing end 130 to project through the upper bars 102 to a point below the bottom of the complemtary cutter bars 103.

During this stage of the process, filter cake is extruded through the openings formed by the shredder bar 102 and complemtary cutter bars 103. The wiper blade lower end drops off the shredder bar 102 onto or past the complemtary cutter bars 103 with a snapping action and punches filter cake through the openings. The trailing edge of the wiper blade lower end shears the extruded filter cake as the forward portion of the wiper blade lower end extrudes additional filter cake.

As indicated in FIGS. 2 through 5 by arrows 303, 403 and 503, the live bottom travels first in one direction. It then reverses its direction of travel and transverse the bottom of the filter cake shredder and pan loader assembly 100 in the other direction.

The filter cake can be confined within the hopper region of the filter cake shredder and pan loader assembly 100 by the lower end of the side walls of the hopper, or alternatively, wiper blades 306 can be used. The use of wiper blades 306 at the housing ends eliminates the need to provide a clearance space 120 between the hopper 115 and the shuttle bar assembly 101.

The entire wiper blade and shuttle bar assembly can be remove for ease of cleaning or replacement with an alternate unit to satisfy the requirements of a different material.

Figure 6:
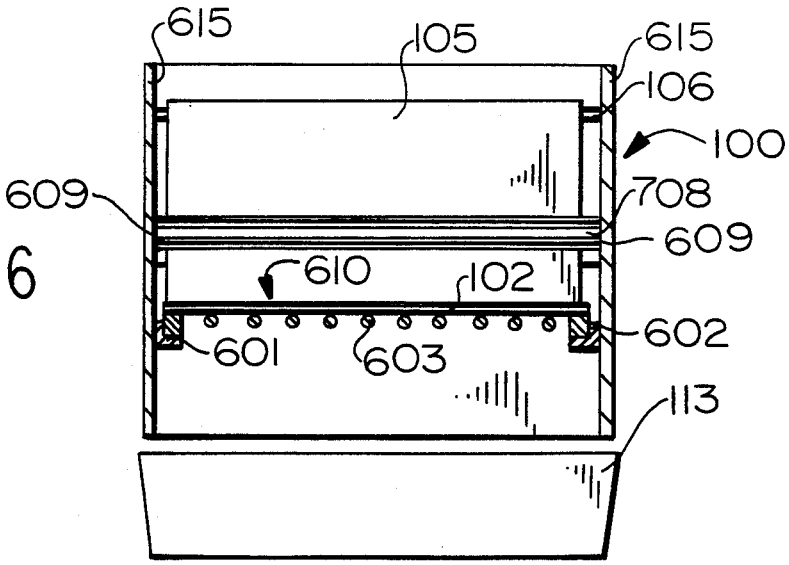
FIG. 6 is a schematic cross-sectional end view of a shredding and collecting assembly of FIG. 1.

It is evident from FIG. 6 that the wiper blade upper end 105 extends across the full width of the shuttle bar assembly 101 and oscillates about the wiper blade rotational carrier bar 708 to the extent permitted by the wiper blade stop 106 and wiper blade stop 107 which engage the wiper blade upper end 105. The wiper blade rotational carrier bar 708 can be provided with a wiper blade receiving slot 701 for receiving the wiper blade upper end 105. The wiper blade upper end 105 can be fixed in place by means of set screws located at spaced positions in set screw receiving openings 702. The wiper blade rotational carrier bar 708 is mounted in place for oscillating movement by means of retaining pins 609. Each end of the wiper blade rotational carrier bar 708 is provided with rotation pin receiving openings 703 for the mounting pins 609.

The interaction between the wiper blades 105, the filter cake 104 and the shredder assembly 101 can be controlled by raising or lowering the wiper blade with respect to the shuttle bar assembly 101. This can conveniently be achieved by providing a vertical adjusting mechanism for the carrier bar 708. The vertical adjusting mechanism thus increase or decrease the force exerted on the filter cake by the wiper blades.

The live bottom 610 can be formed of complementary cutter bars 603 which are preferably welded to the shredder bar 102 at a plurality of cross points. The shuttle supports 602 are suported by shuttle guide 602 which are fixed to the filter cake shredder and pan loader assembly 100 end walls 615.

In another aspect of the invention, the shredder can be employed to particlize friable material which can be either wet or dry. Thus, while the mechanism of the instant invention works with materials as pasty as peanut butter, it can convert blocks of material such as rigid, expanded polystyrene blocks into small particles.

In accordance with the process of the invention a wiper blade of a flexible material is drawn across a shredding screen which is formed of a first set of spaced parallel bars and a second set of parallel spaced bars. The second set of spaced parallel bars are at a right angle to the first set of spaced parallel bars. The wiper blade is a semi-rigid member formed of a material such as a hard urethane or rubber. The lower end of the wiper blade is positioned for firm contact with the spaced parallel bars of the shredding screen. The upper section of the wiper blade is supported for limited oscillatory movement in order to act on the filter cake during the shredding operation. It should be understood that the wiper blades can be fixed in place, depending upon system requirements. The process involves dumping the filter cake into a hopper which sits over the shredding screen. The shredding screen is moved relative to the wiper blade thereby forcing the filter cake mass through the shredding screen as descrete particles. The descrete particles are collected in a pan and conveyed to a dryer. The system of the instant invention provides among its advantages, the rapid production of descrete particles with a relatively low energy requirement for the particle forming operation and the increase in speed of the drying operation with a concomittent decrease in the energy requirement of the drying operation.

The number of wiper blades and the space between the blades is not critical, but rather can be selected depending upon the desired results and the rheology of the filter

GLOSSARY

| Reference Number | Description |
|---|---|
| 100 | filter cake shredder and pan loader assembly |
| 101 | shuttler bar assembly |
| 102 | shredder bar |
| 103 | complemtary cutter bars |
| 104 | filter cake |
| 105 | wiper blade upper end |
| 106 | wiper blade stop |
| 107 | wiper blade stop |
| 108 | wiper blade assembly |
| 109 | shuttle drive means |
| 110 | arrow |
| 111 | shredded particles |
| 112 | collection of shredded particles |
| 113 | pan |
| 114 | conveyor mechanism |
| 115 | hopper |
| 116 | wiper blade lower end |
| 117 | extruding filter cake |
| 120 | clearance between the hopper and the shuttle bar assembly 101 |
| 201 | arrow |
| 301 | arrow |
| 501 | arrow |
| 601 | shuttle support |
| 602 | shuttle guide |
| 603 | shredder cross bar |
| 609 | mounting pins |
| 610 | live bottom |
| 615 | end walls |
| 701 | wiper blade receiving slot |
| 702 | set screw receiving opening |
| 703 | rotation pin receiving opening |
| 708 | wiper blade rotational carrier bar |

I claim:

1. A shredding apparatus for use in shredding a material mass into a plurality of descrete particles, comprising;

(a) shredding screen means, (b) wiper blade means, said wiper blade means including a semi-rigid blade having its lower end in firm contact with said shredding screen means and wherein said wiper blade means includes a plurality of spaced wiper blades, (c) reciprocating means, said reciprocating means being fixed to said shredding screen means to provide reciprocating motion of the shredding screen relative to said wiper blade and wherein said reciprocating means means produces a length of travel of said shredding screen at least equal to the space between an adjacent pair of wiper blades, (d) an oscillatory support member affixed to each of said spaced wiper blades, each of said wiper blades being elongated essentially flat structures lying in a plane which is normal to said screen when the blade is in the vertical position and which is transverse to the direction of motion of the screen whereby each of said wiper blades is supported between its upper and lower end for limited oscillatory movement about an axis which lies in the plane of the wiper blade and wherein said oscillatory motion is produced by said firm contact between said wiper blade means lower end and said shredding screen means.

2. The apparatus of claim 1, wherein said oscillatory support member is a bar having an axially extending slot for receiving a wiper blade.

3. A shredding apparatus for use in shredding a material mass into a plurality of descrete particles, comprising;

(a) shredding screen means, said shredding means comprising a first set of spaced parallel bars and a second set of spaced parallel bars, (b) wiper blade means, said wiper blade means including a semi-rigid blade having its lower end in firm contact with said shredding screen means, (c) reciprocating means, said reciprocating means being fixed to said shredding screen means to provide reciprocating motion of the shredding screen relative to said wiper blade, said wiper blade being in a first plane, said first set of spaced parallel bars being parallel to the plane of said wiper blade means and overlying said second set of spaced parallel bars and being substantially perpendicular to said second set of spaced parallel bars thereby forming plurality of openings having a predetermined cross-sectional area substantially equal to the required cross-sectional area substantially equal to the required cross-sectional area of said discrete particles and wherein said wiper blade means includes a plurality of spaced wiper blades and said reciprocating means means produces a length of travel of said shredding screen at least equal to the space between an adjacent pair of wiper blades, each of said wiper blades being parallel to said first set of spaced parallel bars and supported for travel such that during each pass of the reciprocating motion the lower edge of each wiper blade repeatedly slides along the top of a bar of said first set of spaced parallel bars, snaps downward towards said second set of spaced parallel bars.

4. The apparatus of claim 3, wherein said wiper blades are made of a urethane polymer.

5. The method of processing a filter cake having a pasty consistency, into discrete filter cake particles comprising the steps of;

dumping a pasty filter cake into a hopper means, said hopper means means having a filter cake receiving opening at its upper end, contacting said filter cake with wiper blade means, said wiper blade means including a semi-rigid blade having its lower end in firm contact with a shredding screen means, reciprocating said shredding screen means relative to said wiper blade and shredding said filter cake between said wiper blade and a bar means which extends parallel to said wiper blade while wiping filter cake through said shredding screen means with each pass of said wiper blade means, thereby forming discrete filter cake particles.

6. The method of claim 5, wherein said shredding screen means comprises a first set of spaced parallel bars and a second set of spaced parallel bars, said first set of spaced parallel bars being parallel to the plane of said wiper blade means and overlying said said second set of spaced parallel bars and being substantially perpendicular to said second set of spaced parallel bars thereby forming a plurality of openings having a predetermined cross-sectional area substantially equal to the required cross-sectional area of said descrete particles, and wherein said wiper blade means includes a plurality of spaced wiper blades, each of said wiper blades being parallel to said first set of spaced parallel bars and supported for travel such that the lower edge of each wiper blade extends below the upper edge of the bars of said first set of spaced parallel bars; the steps of reciprocating said shredding screen to produce a length of travel of said shredding screen at least equal to the space between an adjacent pair of wiper blades, and during each pass of the reciprocating motion, repeatedly sliding the lower edge of each wiper blade along the top of each of the bars of said first set of spaced parallel bars contacted during each pass, and repeatedly snaping said lower edge downward toward said second set of spaced parallel bars, thereby continuously wiping filter cake through said plurality of openings.

7. The method of claim 6, further comprising the step of collecting said discrete particles which pass through said shredding screen means, transporting said particles while still in the form of a collection of discrete particles to a dryer, heating said collection of discrete particles in said dryer until said descrete are substantially dry.

* * * * *